US007084394B2

(12) United States Patent
Guevremont et al.

(10) Patent No.: US 7,084,394 B2
(45) Date of Patent: Aug. 1, 2006

(54) FAIMS APPARATUS AND METHOD FOR SEPARATING IONS

(75) Inventors: Roger Guevremont, Ottawa (CA); Lucien Potvin, Kanata (CA)

(73) Assignee: Ionalytics Corporation, Ottawa (CA)

( * ) Notice: Subject to any disclaimer, the term of this patent is extended or adjusted under 35 U.S.C. 154(b) by 0 days.

(21) Appl. No.: 10/529,308

(22) PCT Filed: Aug. 28, 2003

(86) PCT No.: PCT/CA03/01318

§ 371 (c)(1),
(2), (4) Date: Mar. 25, 2005

(87) PCT Pub. No.: WO2004/030022

PCT Pub. Date: Apr. 8, 2004

(65) Prior Publication Data

US 2006/0038119 A1 Feb. 23, 2006

Related U.S. Application Data

(60) Provisional application No. 60/413,162, filed on Sep. 25, 2002.

(51) Int. Cl.
*H01J 49/00* (2006.01)

(52) U.S. Cl. ..... 250/286; 250/282

(58) Field of Classification Search ..... 250/286, 250/281, 282

See application file for complete search history.

(56) References Cited

U.S. PATENT DOCUMENTS

| | | | | |
|---|---|---|---|---|
| 5,354,988 | A * | 10/1994 | Jullien | 250/292 |
| 5,495,168 | A | 2/1996 | De Vries | |
| 5,793,642 | A | 8/1998 | Frisch et al. | |
| 5,801,379 | A | 9/1998 | Kouznetsov | |
| 2005/0269500 | A1 * | 12/2005 | Potvin et al. | 250/281 |

FOREIGN PATENT DOCUMENTS

| | | |
|---|---|---|
| EP | 0 701 138 | 3/1996 |
| WO | WO 92/15150 | 9/1992 |

* cited by examiner

*Primary Examiner*—Kiet T. Nguyen
(74) *Attorney, Agent, or Firm*—Freedman & Associates

(57) ABSTRACT

A method of controlling an asymmetric waveform that is generated as a combination of a plurality of sinusoidal waves, including two sinusoidal waves having a frequency that differs by a factor of two. The method includes the steps of sampling the generated asymmetric waveform to obtain a set of data points that is indicative of the generated asymmetric waveform. Each data point of the set of data points normalized. The method further includes the steps of determining at least a value relating to the normalized data points of comparing the determined at least a value to template data relating to an ideal asymmetric waveform, and of effecting a change to the generated asymmetric waveform in dependence upon the comparison.

28 Claims, 4 Drawing Sheets

FAIMS APPARATUS AND METHOD FOR SEPARATING IONS

This application claims the benefit of U.S. Provisional Application No. 60/413,162, filed Sep. 25, 2002.

FIELD OF THE INVENTION

The instant invention relates generally to high field asymmetric waveform ion mobility spectrometry (FAIMS), more particularly the instant invention relates to a method of optimizing asymmetric waveform generator LC tuning electronics.

BACKGROUND OF THE INVENTION

High sensitivity and amenability to miniaturization for field-portable applications have helped to make ion mobility spectrometry (IMS) an important technique for the detection of many compounds, including narcotics, explosives, and chemical warfare agents as described, for example, by G. Eiceman and Z. Karpas in their book entitled "Ion Mobility Spectrometry" (CRC, Boca Raton, 1994). In IMS, gas-phase ion mobilities are determined using a drift tube with a constant electric field. Ions are separated in the drift tube on the basis of differences in their drift velocities. At low electric field strength, for example 200 V/cm, the drift velocity of an ion is proportional to the applied electric field strength, and the mobility, K, which is determined from experimentation, is independent of the applied electric field. Additionally, in IMS the ions travel through a bath gas that is at sufficiently high pressure that the ions rapidly reach constant velocity when driven by the force of an electric field that is constant both in time and location. This is to be clearly distinguished from those techniques, most of which are related to mass spectrometry, in which the gas pressure is sufficiently low that, if under the influence of a constant electric field, the ions continue to accelerate.

E. A. Mason and E. W. McDaniel in their book entitled "Transport Properties of Ions in Gases" (Wiley, N.Y. 1988) teach that at high electric field strength, for instance fields stronger than approximately 5,000 V/cm, the ion drift velocity is no longer directly proportional to the applied electric field, and K is better represented by $K_H$, a non-constant high field mobility term. The dependence of $K_H$ on the applied electric field has been the basis for the development of high field asymmetric waveform ion mobility spectrometry (FAIMS). Ions are separated in FAIMS on the basis of a difference in the mobility of an ion at high field strength, $K_H$, relative to the mobility of the ion at low field strength, K. In other words, the ions are separated due to the compound dependent behavior of $K_H$ as a function of the applied electric field strength.

In general, a device for separating ions according to the FAIMS principle has an analyzer region that is defined by a space between first and second spaced-apart electrodes. The first electrode is maintained at a selected dc voltage, often at ground potential, while the second electrode has an asymmetric waveform V(t) applied to it. The asymmetric waveform V(t) is composed of a repeating pattern including a high voltage component, $V_H$, lasting for a short period of time $t_H$ and a lower voltage component, $V_L$, of opposite polarity, lasting a longer period of time $t_L$. The waveform is synthesized such that the integrated voltage-time product, and thus the field-time product, applied to the second electrode during each complete cycle of the waveform is zero, for instance $V_H t_H + V_L t_L = 0$; for example +2000 V for 10 μs followed by −1000 V for 20 μs. The peak voltage during the shorter, high voltage portion of the waveform is called the "dispersion voltage" or DV, which is identically referred to as the applied asymmetric waveform voltage.

Generally, the ions that are to be separated are entrained in a stream of gas flowing through the FAIMS analyzer region, for example between a pair of horizontally oriented, spaced-apart electrodes. Accordingly, the net motion of an ion within the analyzer region is the sum of a horizontal x-axis component due to the stream of gas and a transverse y-axis component due to the applied electric field. During the high voltage portion of the waveform an ion moves with a y-axis velocity component given by $v_H = K_H E_H$, where $E_H$ is the applied field, and $K_H$ is the high field ion mobility under operating electric field, pressure and temperature conditions. The distance traveled by the ion during the high voltage portion of the waveform is given by $d_H = v_H t_H = K_H E_H t_H$, where $t_H$ is the time period of the applied high voltage. During the longer duration, opposite polarity, low voltage portion of the asymmetric waveform, the y-axis velocity component of the ion is $v_L = KE_L$, where K is the low field ion mobility under operating pressure and temperature conditions. The distance traveled is $d_L = v_L t_L = KE_L t_L$. Since the asymmetric waveform ensures that $(V_H t_H) + (V_L t_L) = 0$, the field-time products $E_H t_H$ and $E_L t_L$ are equal in magnitude. Thus, if $K_H$ and K are identical, $d_H$ and $d_L$ are equal, and the ion is returned to its original position along the y-axis during the negative cycle of the waveform. If at $E_H$ the mobility $K_H > K$, the ion experiences a net displacement from its original position relative to the y-axis. For example, if a positive ion travels farther during the positive portion of the waveform, for instance $d_H > d_L$, then the ion migrates away from the second electrode and eventually will be neutralized at the first electrode.

In order to reverse the transverse drift of the positive ion in the above example, a constant negative dc voltage is applied to the second electrode. The difference between the dc voltage that is applied to the first electrode and the dc voltage that is applied to the second electrode is called the "compensation voltage" (CV). The CV voltage prevents the ion from migrating toward either the second or the first electrode. If ions derived from two compounds respond differently to the applied high strength electric fields, the ratio of $K_H$ to K may be different for each compound. Consequently, the magnitude of the CV that is necessary to prevent the drift of the ion toward either electrode is also different for each compound. Thus, when a mixture including several species of ions, each with a unique $K_H/K$ ratio, is being analyzed by FAIMS, only one species of ion is selectively transmitted to a detector for a given combination of CV and DV. In one type of FAIMS experiment, the applied CV is scanned with time, for instance the CV is slowly ramped or optionally the CV is stepped from one voltage to a next voltage, and a resulting intensity of transmitted ions is measured. In this way a CV spectrum showing the total ion current as a function of CV, is obtained.

In FAIMS, the optimum dispersion voltage waveform for obtaining the maximum possible ion detection sensitivity on a per cycle basis takes the shape of an asymmetric square wave with a zero time-averaged value. In practice this asymmetric square waveform is difficult to produce and apply to the FAIMS electrodes because of electrical power consumption considerations. For example, without a tuned circuit the power P which would be required to drive a capacitive load of capacitance C, at frequency f, with a peak voltage V, is $2\pi V^2 fC$. Accordingly, if a square wave at 750 kHz, 4000 V peak voltage is applied to a 20 picofarad load, the power consumption will be 240 Watts. If, on the other hand, a waveform is applied via a tuned circuit, the power consumption is reduced to P(cos Θ) where Θ is the angle between the current and the voltage applied to the capacitive load. This power consumption approaches zero if the current and voltage are out of phase by 90 degrees, as they would be in a perfectly tuned LC circuit.

Since a tuned circuit cannot provide a square wave, an approximation of a square wave is taken as the first terms of a Fourier series expansion. One possible approach is to use:

$$V(t) = \frac{2}{3}D\sin(\omega t) + \frac{1}{3}D\sin(2\omega t - \pi/2) \tag{1}$$

Where V(t) is the asymmetric waveform voltage as a function of time, D is the peak voltage (defined as dispersion voltage DV), ω is the waveform frequency in radians/sec. The first term is a sinusoidal wave at frequency ω, and the second term is a sinusoidal wave at double the frequency of the first sinusoidal wave, 2ω. The second term could also be represented as a cosine, without the phase shift of π/2.

In practice, both the optimization of the LC tuning and maintenance of the exact amplitude of the first and second applied sinusoidal waves and the phase angle between the two waves is required to achieve long term, stable operation of a FAIMS system powered by such an asymmetric waveform generator. Accordingly, feedback control is required to ensure that the output signal is stable and that the correct waveform shape is maintained.

In U.S. Pat. No. 5,801,379, which was issued on Sep. 1, 1998, Kouznetsov teaches a high voltage waveform generator having separate phase correction and amplitude correction circuits. This system uses additional hardware components in the separate phase correction and amplitude correction circuits, thereby increasing complexity and increasing the cost of manufacturing and testing the devices. Furthermore, this system cannot be implemented into control software, making it difficult to vary certain parameters.

It is an object of the instant invention to provide a method of optimizing asymmetric waveform generator LC tuning electronics that overcomes the limitations of the prior art.

SUMMARY OF THE INVENTION

In accordance with an aspect of the instant invention there is provided a method of controlling an asymmetric waveform generated as a combination of a plurality of sinusoidal waves including two sinusoidal waves having a frequency that differs by a factor of two, the method comprising the steps of: sampling the generated asymmetric waveform to obtain a set of data points that is indicative of the generated asymmetric waveform; normalizing each data point of the set of data points; determining at least a value relating to the normalized data points; comparing the determined at least a value to template data relating to an ideal asymmetric waveform; and, in dependence upon the comparison, effecting a change to the generated asymmetric waveform.

In accordance with another aspect of the instant invention there is provided a method of controlling an asymmetric waveform generated as a combination of a plurality of sinusoidal waves including two sinusoidal waves having a frequency that differs by a factor of two, the method comprising the steps of: sampling the generated asymmetric waveform to determine a plurality of data points from a plurality of different cycles of the generated asymmetric waveform, the plurality of data points being indicative of a shape of the generated asymmetric waveform; analyzing the plurality of data points indicative of a shape of the generated asymmetric waveform, the step of analyzing being performed other than in dependence upon an order of magnitude of the data points; and, in dependence upon the step of analyzing, effecting a change to the generated asymmetric waveform.

In accordance with still another aspect of the instant invention there is provided a storage medium encoded with machine-readable computer program code for controlling an asymmetric waveform generated as a combination of a plurality of sinusoidal waves including two sinusoidal waves having a frequency that differs by a factor of two, the storage medium including instructions for: obtaining a set of data points that is indicative of the generated asymmetric waveform; normalizing the data points of the set of data points; applying a predetermined function to the normalized data points of the set of data points, to determine a set of resultant values including one resultant value corresponding to each normalized data point of the set of normalized data points; determining at least a value relating to the set of resultant values; comparing the determined at least a value to template data relating to an ideal asymmetric waveform; and, in dependence upon the comparison, adjusting at least one of a phase angle difference between the two sinusoidal waves and an amplitude of at least one of the two sinusoidal waves.

BRIEF DESCRIPTION OF THE DRAWINGS

Exemplary embodiments of the invention will now be described in conjunction with the following drawings, in which similar reference numbers designate similar items.

DETAILED DESCRIPTION OF THE DRAWINGS

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein.

As is noted above, the waveform applied in FAIMS is a combination of two sinusoidal waves of frequency ω and 2ω. The two waves are of amplitudes that differ by a factor of two and are also offset by a phase angle (Θ), resulting in a waveform that is defined by, for example, Equation 2, below:

$$V(t)=A\sin(\omega t)+B\sin(2\omega t-\Theta) \quad (2)$$

where V(t) is the asymmetric waveform voltage as a function of time, A is the amplitude of the first sinusoidal wave at frequency ω, where ω is the frequency in radians/sec, and B is the amplitude of the second sinusoidal wave at a frequency 2ω. This second sinusoidal wave is offset from the first by a phase angle Θ, which preferably is equal to π/2. In practice, the CV is often applied to the same electrode as the asymmetric waveform and this dc offset is added to V(t) in Equation 2.

Using the approach of Equation 1, in a waveform having an optimum shape, A=2B, and Θ is equal to π/2. The electronic circuit maintains these two conditions in order to achieve the waveform with the correct asymmetric waveform shape for stable performance of a FAIMS system attached thereto. In a related function, the peak voltage on the highest voltage side of the asymmetric waveform (defined as DV above) is constant, and equal to A+B. The electronic circuit therefore tracks, modifies and controls three parameters, namely A, B and Θ while simultaneously ensuring that A=2B and that A+B equals the dispersion voltage (DV). Also, the waveform voltage at the dip in the waveform on the opposite polarity from DV is equal to A−B.

Figure 1:
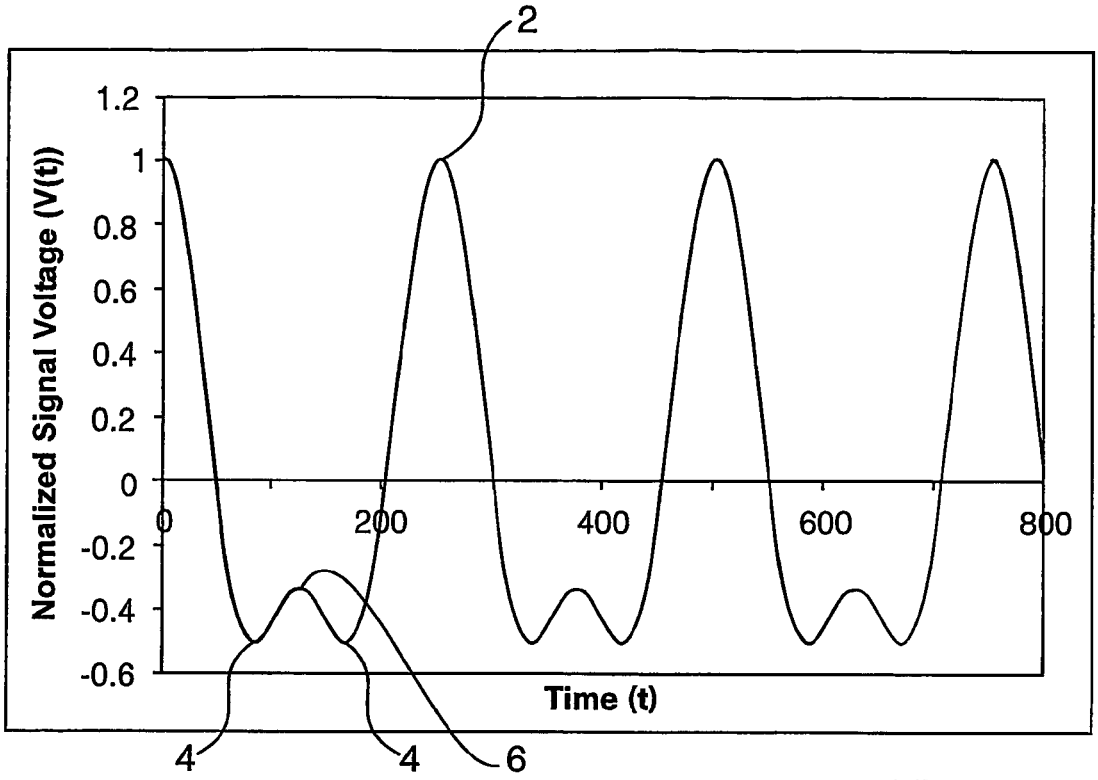
FIG. 1 shows a plurality of cycles of an asymmetric waveform that is formed as a combination of first and second sinusoidal waves of frequency ω and 2ω, respectively.

Referring to FIG. 1, shown is a plurality of cycles of an ideal asymmetric waveform that is formed as a combination of first and second sinusoidal waves of frequency ω and 2ω, respectively. The asymmetric waveform shape shown in FIG. 1 can for example be established by collecting sample data points from the waveform, such as by analog-to-digital (A/D) sampling, in order to acquire a representative set of data points from all portions of the asymmetric waveform. The A/D data points are optionally taken randomly, at frequencies that are higher than or lower than the waveform itself. However, it is necessary that this array of data points of the signal intensity of the asymmetric waveform correctly represent all time periods within the waveform. For example, the sample data points should include points near the peak voltage 2 in the polarity of maximum voltage applied, as well as points near the two peaks 4 of maximum voltage at the other polarity and in the dip 6 between the two peaks 4. If the waveform is sampled across all times, the series of points thus acquired can be subjected to simple tests to determine if the waveform shape is optimum.

The values of A and B are taken so that, in the instant example, A+B=1 and A/B=2. The peak values 2 of the waveform are therefore equal to A+B. The opposite polarity part of the waveform, negative polarity in this example, is characterized by a dip 6 and two peak values 4. The value at dip 6 is A−B (in this case A−B=⅓), and the peaks 4 in the opposite polarity are each (A+B)/2 (in this case (A+B)/2=½).

Three specific types of deviation from the ideal asymmetric waveform are possible: first, a phase shift error; second an error in the ratio of A/B (keeping A+B=1); and third, an error in the sum of A+B (keeping the ratio A/B=2). The electronics of a not illustrated asymmetric waveform generator must be able to identify such deviations from the ideal waveform shape, and make adjustments to the drive electronics accordingly. In the instant method, it is assumed that A+B is set to the desired value, and accordingly the third type of error is corrected independently of the other two types of errors.

Figure 2:
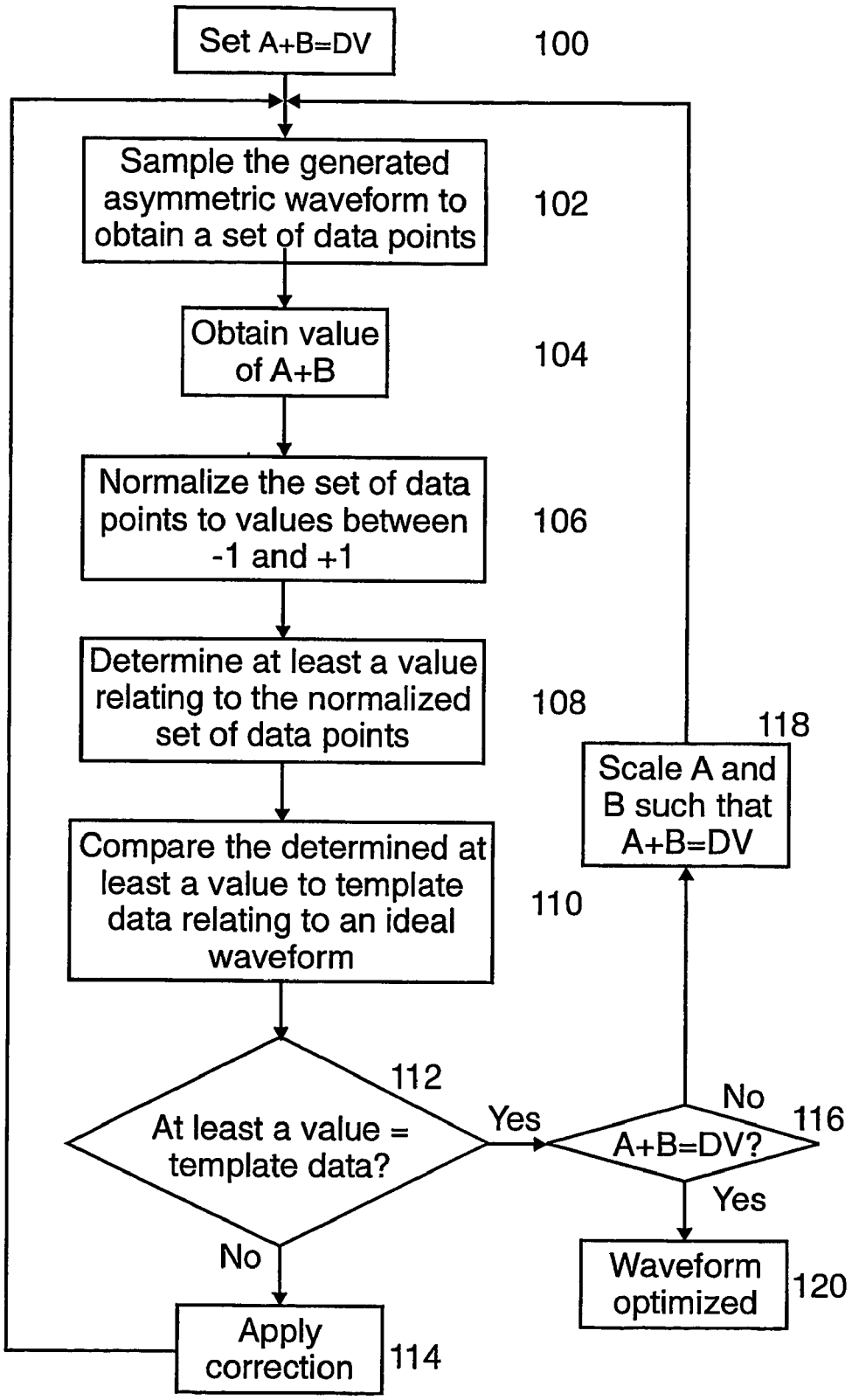
FIG. 2 is a simplified flow diagram of a method of optimizing asymmetric waveform generator LC tuning electronics according to an embodiment of the instant invention.

Referring now to FIG. 2, shown is a simplified flow diagram of a method of optimizing asymmetric waveform generator LC tuning electronics according to an embodiment of the instant invention. At optional step 100, the sum of the amplitudes of the two sinusoidal waves, A+B, is set to a predetermined value, for instance, A+B=DV. At step 102 the generated asymmetric waveform is sampled to obtain a set of data points. For example, step 102 is performed as a fast analog-to-digital sampling (A/D) of the waveform voltage to collect 100 data points within one cycle of the waveform. A plot of the magnitude, or A/D values, of these data points as a function of time of collection yields a trace that resembles an oscilloscope trace of the original generated asymmetric waveform. Alternatively, the set of data points is obtained as a slow, random, sampling version of A/D, which eventually collects sample data points from every portion of the generated asymmetric waveform. For example, the A/D collection of 100 data points randomly, one new data point each millisecond, results in the acquisition of the 100 data points in approximately 100 milliseconds. Since the asymmetric waveform is repeating rapidly, perhaps in the megahertz range, no two of these A/D data points is sampled from the same cycle of the waveform. However, each data point is sampled from somewhere during the cycle of the waveform. Similarly, each one of the following ninety-nine data points is sampled from a random point in a widely separated (in time) cycle of the waveform, relative to the previous data point. If the data points are actually random, then every region of the generated asymmetric waveform, given the finite number of data points collected, is sampled although one does not know from which time in the period of the generated asymmetric waveform each data point is acquired. One cannot reconstruct the equivalent of an oscilloscope trace of the original waveform shape because the "time" values of the data points relative to the original waveform is unknown, hence the randomness of this sampling method.

At step 104, the value of A+B is obtained. For example, the set of data points is provided to a processor having stored therein computer readable program code for processing the set of data points according to a predetermined process. For example, the value of A+B is found by searching for the largest absolute magnitude (most positive or most negative) data point in the set of data points. At step 106, the data points are normalized. That is to say, after the value of A+B is obtained, all of the points are divided by the absolute magnitude value, so that all data points fall between −1 and +1.

At step 108, at least a value relating to the normalized set of data points is determined. For example, the set of data points is provided to a processor having stored therein computer readable program code for processing the set of data points according to a predetermined process. In order to facilitate a better understanding of the instant invention, step 108 will be discussed in greater detail by way of a specific and non-limiting example in which a value relating to an average of the cubed value of the individual data points of the set of data points ("average of the cubes") is determined. For example, if the A/D normalized result is 0.4, then 0.4 cubed is 0.4 times 0.4 times 0.4 equals 0.064. In this example −1 cubed is of course equal to −1, and −0.2 cubed is equal to −0.008. These examples are given to avoid misunderstanding of this extremely simple process. In addition, the sign of the result is important. The average of the cubed value of the normalized data points is taken as the sum of the cubes divided by the number of normalized data points. The average is not dependent upon the number of data points collected, unless the number of data points is too small. Of course, the sum of the cubed values could be used as an alternative to the "average of the cubes." Use of the sum gives a value that depends upon the number of data points collected. In addition, use of other functions, including squares, will be discussed in greater detail, below.

The "average of the cubes" reaches a maximum absolute value when the asymmetric waveform is optimized. For example, when DV of an ideal asymmetric waveform is positive, the "average of the cubes" of the normalized waveform is also positive and equal to approximately +0.111. When the DV is negative the "average of the cubes" is negative and equal to approximately −0.111. In each case, if the phase angle offset between the two sinusoidal waves is changed from the optimum value of $\pi/2$, then the "average of the cubes" begins to deviate towards zero, i.e. the absolute value of the "average of the cubes" decreases. Similarly, if the relative ratio of A/B deviates from the optimum value of 2, the "average of the cubes" also deviates towards zero.

In the process using the "average of the cubes", the objective of the electronic control circuit and computer code is therefore to adjust the values of A, B and the phase angle to maximize, with the correct sign, the value of the "average of the cubes." At this maximum of the "average of the cubes", the normalized positive polarity asymmetric waveform is shaped in the way that is shown in FIG. 1. Accordingly, at step 110 the determined at least a value is compared to template data relating to the ideal waveform. In the instant example, where the polarity of the DV is positive, the template data relating to the ideal waveform is a single value, namely approximately +0.111.

At decision step 112, it is determined whether the at least a value is equal to the template data relating to the ideal waveform. If the answer at decision step 112 is yes, then the shape of the generated asymmetric waveform is optimized to the ideal shape; however, the absolute magnitudes of the two sinusoidal waves may be incorrect. Accordingly, at decision step 116 it is determined whether the value of A+B is equal to DV. If the answer at decision step 116 is no, then at step 118 the values of A and B are scaled in the appropriate direction, keeping the ratio A/B constant, such that the condition A+B=DV is satisfied. If the answer at decision step 116 is yes, then the waveform is considered at step 120 to be optimized.

If the answer at decision step 112 is no, then the shape of the generated asymmetric waveform is likely not optimized, and corrective action is required at step 114. Typically, applying a correction to the generated asymmetric waveform involves adjusting at least one of the phase angle offset between the two sinusoidal waves ($\Theta$), and the relative magnitudes of the two sinusoidal waves (A/B). Steps 102 to 112 are then repeated.

Once the generated asymmetric waveform is optimized, re-optimization is carried out, for example, at times dependent on the expected drift rates in the amplitudes of the sinusoidal waves and expected drifts in phase angles that may be related to operating temperature, etc.

Figure 3:
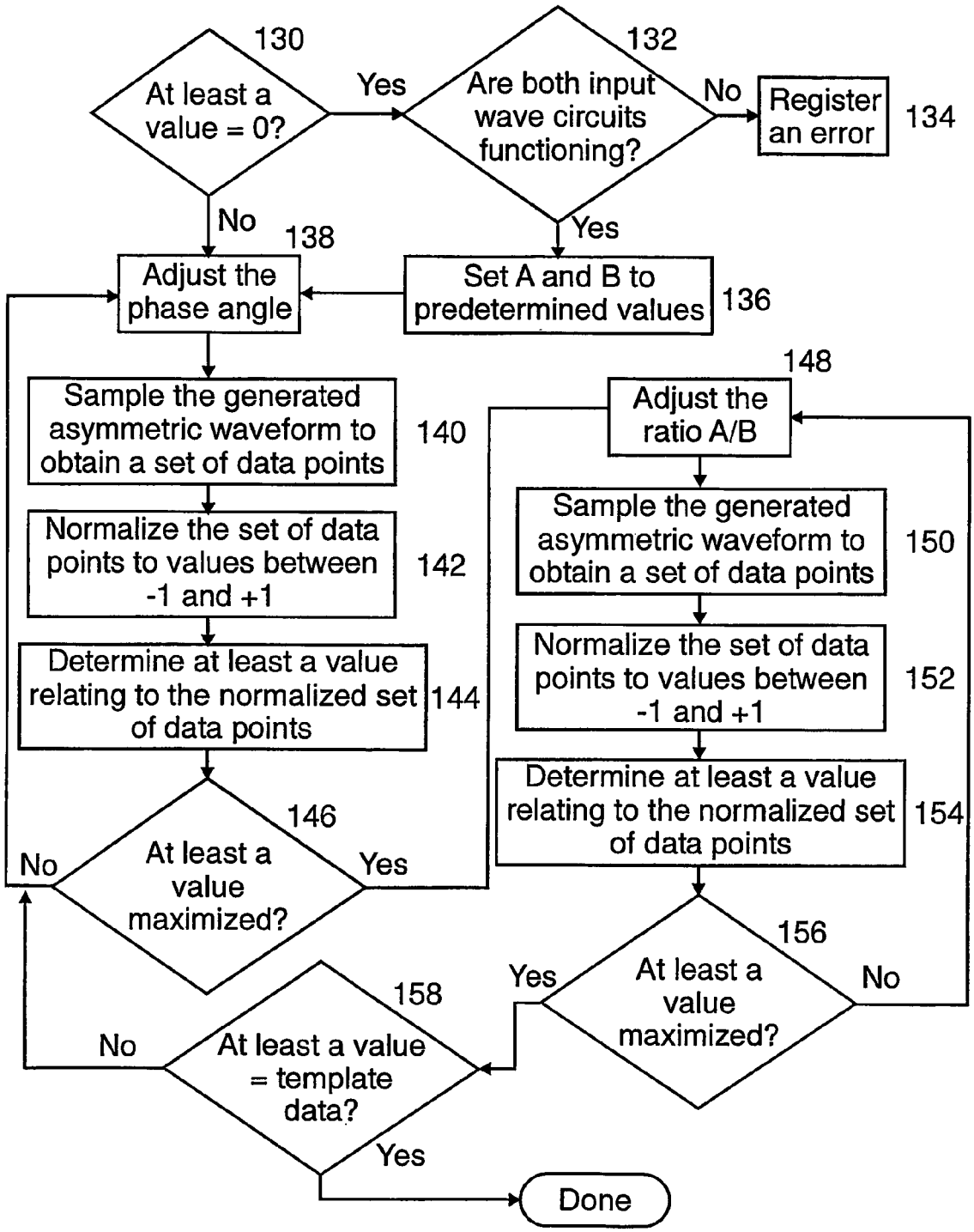
FIG. 3 is a simplified flow diagram of a method of applying a correction at step 114 of FIG. 2 according to an embodiment of the instant invention; and, FIG. 4 is a simplified flow diagram of another method of applying a correction at step 114 of FIG. 2 according to an embodiment of the instant invention.

Referring now to FIG. 3, shown is a simplified flow diagram of a method of optimization of the shape of an asymmetric waveform, with positive DV, according to an embodiment of the instant invention. At decision step 130, it is determined whether the at least a value, in this case the "average of the cubes", is equal to zero. If the answer at decision step 130 is yes, then at decision step 132 it is determined whether both input wave circuits are functioning correctly. For example, if the output of the waveform generator is sinusoidal, as would be the case when one of the two input sinusoidal waves is zero, then modification of the phase angle offset or the relative amplitudes of the input waves cannot change the "average of the cubes" to a non-zero value. If the "average of the cubes" is zero, both input sinusoidal waves are set to a predefined value, without concern about the particular ratio of A/B. If the "average of the cubes" remains at zero, then a failure of one of the two input waves is possible. If under these conditions the phase angle offset is changed and the "average of the cubes" continues to be fixed at zero, failure of one of the input waves is certain and an error is registered at step 134. If it is determined at step 132 that both input wave circuits are functioning correctly, then the amplitudes of the two sinusoidal waveforms are set to predetermined values at step 136, and optimization of the generated asymmetric waveform shape continues.

After ensuring that the two sinusoidal waves are functional, the "average of the cubes" is maximized by adjusting the phase angle offset between the two sinusoidal waves. For instance, at step 138 the phase angle offset is adjusted to effect a change to the shape of the generated asymmetric waveform. At step 140, the generated asymmetric waveform is sampled in a manner similar to that described above with reference to FIG. 2. A set of data points acquired at step 140 is normalized at step 142, and a new at least a value is determined relating to the normalized set of data points of the adjusted waveform at step 144. At step 146 it is determined whether the new at least a value is at a maximum value. For example, this is done in an iterative manner until additional changes to the phase angle offset result in a decrease to the new at least a value. Note that the maximum value at this stage may be a value other than +0.111.

Following maximization of the "average of the cubes" by adjusting the phase angle offset, the relative amplitudes of the two sinusoidal waves are modified. The amplitude of each sinusoidal wave is increased and decreased to ascertain the direction of change necessary to maximize the "average of the cubes." For example, at step 148 the ratio A/B is adjusted. At step 150, the generated asymmetric waveform is sampled in a manner similar to that described above with reference to FIG. 2. A set of data points acquired at step 150 is normalized at step 152, and a new at least a value is determined relating to the normalized set of data points of the adjusted waveform is determined at step 154. At step 156 it is determined whether the new at least a value is at a maximum value. For example, this is done in an iterative manner until additional changes to the ratio A/B results in a decrease to the new at least a value. Again, note that the maximum value at this stage may be a value other than +0.111.

If it is determined at decision step 158 that the new at least a value is equal to the template data, which in this case is +0.111, then the corrective action is complete. However, if the new at least a value is different than the template data, then at step 138 the phase angle offset is again changed until the average of the cubes is maximized, etc. This cyclic process continues until the "average of the cubes" converges to 0.111.

Figure 4:
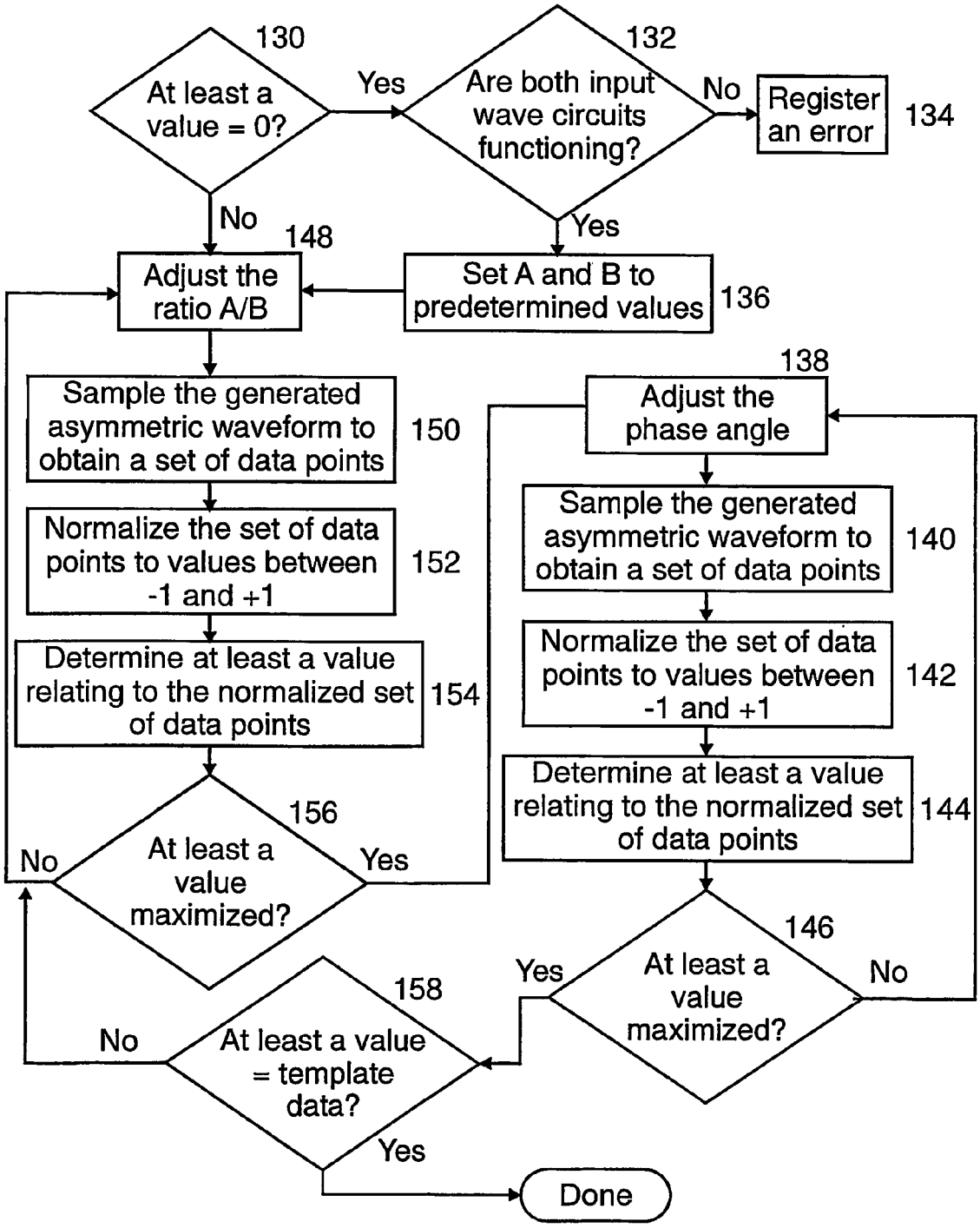

Referring now to FIG. 4, shown is a simplified flow diagram of another method of optimizing the shape of a positive polarity waveform according to an embodiment of the instant invention. At decision step 130, it is determined whether the at least a value, in this case the "average of the cubes", is equal to zero. If the answer at decision step 130 is yes, then at decision step 132 it is determined whether both input wave circuits are functioning correctly. By way of explanation, if the output of the waveform generator is sinusoidal, as would be the case when one of the two input sinusoidal waves is zero, then modification of the phase angle offset or the relative amplitudes of the input waves cannot change the "average of the cubes" to a non-zero value. For example, it at step 130 the "average of the cubes" is zero, both input sinusoidal waves are set to a predefined value, without concern about the particular ratio of A/B. If the "average of the cubes" remains at zero, then a failure of one of the two input waves is possible. If under these conditions the phase angle offset is changed and the "average of the cubes" continues to be fixed at zero, failure of one of the input waves is certain and an error is registered at step 134. If it is determined at step 132 that both input wave circuits are functioning correctly, then the amplitudes of the two sinusoidal waveforms are set to non-zero values at step 136, and optimization of the generated asymmetric waveform shape continues.

After ensuring significant amplitudes of the two sinusoidal waves, the relative amplitudes of the two sinusoidal waves are modified. The amplitude of each sinusoidal wave is increased and decreased to ascertain the direction of change necessary to maximize the "average of the cubes." For example, at step 148 the ratio A/B is adjusted. At step 150, the generated asymmetric waveform is sampled in a manner similar to that described above with reference to FIG. 2. A set of data points acquired at step 150 is normalized at step 152, and a new at least a value is determined relating to the normalized set of data points of the adjusted waveform is determined at step 154. At step 156 it is determined whether the new at least a value is at a maximum value. For example, this is done in an iterative manner until additional changes to the ratio A/B results in a decrease to the new at least a value. Note that the maximum value at this stage may be a value other than +0.111.

Following maximization of the "average of the cubes" by adjusting the relative amplitudes of the two sinusoidal waves, the phase angle offset between the two sinusoidal waves is adjusted. For instance, at step 138 the phase angle offset is adjusted to effect a change to the shape of the generated asymmetric waveform. At step 140, the generated asymmetric waveform is sampled in a manner similar to that described above with reference to FIG. 2. A set of data points acquired at step 140 is normalized at step 142, and a new at least a value is determined relating to the normalized set of data points of the adjusted waveform at step 144. At step 146 it is determined whether the new at least a value is at a maximum value. For example, this is done in an iterative manner until additional changes to the phase angle offset result in a decrease to the new at least a value. Again, note that the maximum value at this stage may be a value other than +0.111.

If it is determined at decision step 158 that the new at least a value is equal to the template data, which in this case is +0.111, then the corrective action is complete. However, if the new at least a value is different than the template data, then the relative amplitudes of the two sinusoidal waves is again changed until the average of the cubes is maximized, etc. This cyclic process continues until the "average of the cubes" converges to 0.111.

The method described with reference to FIGS. 2 to 4 above is successful because the absolute value of the peak voltage of the waveform is significantly different in the positive and negative polarity of the ideal asymmetric waveform. Referring again to the normalized asymmetric waveform of positive polarity DV shown in FIG. 1, the maxima 2 in the positive polarity are approximately equal to one, whereas the most negative points near 4 are approximately equal to negative one-half. The cube function, applied to all of the data points, covering all parts of the waveform, results in larger valued "cubes" for the points on the higher voltage polarity side of the waveform than the points in the opposite polarity. This tends to push the average of the cubes in the direction of the polarity of DV. It should be noted that application of this process to symmetrical waveforms (such as a sinusoidal wave) results in a zero average of cubes. This is because all points in the positive polarity are matched by a point of equal magnitude in the opposite polarity. The cubes of these two points are of equal magnitude but of opposite polarity, and therefore the average of these two points is zero. This applies to all the points of the waveform, and the net average of the cubes of a sinusoidal wave is zero.

Optionally, another function may be used in place of the cube function. The cube function was chosen merely for illustrative purposes because it automatically maintains the sign of the data points. For instance, a negative value cubed remains negative. The cube function satisfies all the prerequisites for the successful application of this method, which are described in greater detail below.

When applied to positive value data points between zero and one the selected function must be monotonic increasing or decreasing, and preferably have a monotonic increasing or decreasing first derivative, respectively. In addition, the selected function must either retain the sign of the data points or consistently apply the opposite sign to the data points. Finally, the selected function must result in magnitudes of calculated points that are the same regardless of the sign of the data. The term "odd function" is defined by $f(-x)=-f(x)$ and has the properties discussed in the preceding two sentences. For example, the square function optionally is used as long as the calculation enforces the rule that the square of the negative data points results in a negative "square." In this case the "modified square" function squares the absolute value of the data point, and applies the sign of the original data point back to this squared value. Other even polynomial and power functions might have to be adjusted in like manner to maintain the sign of the original data. In other words, the selected function must provide values which distinguish between input points of opposite polarity (in sign, but not in magnitude). The square function ($x^2$) has a monotonic increasing first derivative (2x) and a positive second derivative (+2) at all positive x between zero and one. In this modified square function the correction for signs results in the correct derivatives for negative values of x.

As further clarification of the criteria for selecting a function that can be used for optimization of the waveform, we must re-visit some of the fundamentals of FAIMS. The discussion in the introduction section of this document considered, for the sake of simplicity, the operation of a FAIMS with an applied square wave version of the asymmetric waveform. We now carry that discussion to more detail. In general the integral of the waveform voltage (or field) over one cycle is zero. Using the terminology of the introduction, $E_H t_H$ was equal in magnitude (opposite sign) to $E_L t_L$ which were the integrated field-time products for the positive- and negative-going parts of the waveform. This generalization also applies to the waveform described by Equations (1) and (2). Using the terminology of the introduction, $d_H$ and $d_L$ represent the distances traveled by the ion during each polarity part of the waveform. More specifically $d_H$ and $d_L$ are integrals of the motion defined by KEt over that part of the waveform. Since the integrals of the field-time products, Et, are equal over each polarity of the waveform, the integrals of K over the positive and negative components of the waveform define the relative sizes of $d_H$ and $d_L$. In general, therefore, the net distance traveled by the ion, $d_H - d_L$, can be taken as proportional to the integral of K(E) over the duration of the waveform. The "cube" algorithm described here is equivalent to setting the ion mobility dependence on field equal to $K(E)=K_L(1+\alpha E^3)$ where $\alpha$ is a constant that depends on the compound in question, as well as experimental variables such as the gas composition, temperature, pressure etc. The field E is proportional to the voltage applied V(t), therefore the net displacement of the ion after one waveform cycle is proportional to the integral of $K(V(t)^3)$. In other words, the net displacement of the ion after once cycle of the waveform is maximized (and CV is therefore maximized) if the waveform has a shape V(t) that maximizes the integral of $[V(t)]^3$. This is equivalent to the 'cube' algorithm discussed above which uses the "average of the cubes", and which is one of the functions suggested in this patent application for optimization of the waveform.

From the foregoing discussion it becomes clear that obtaining the maximum CV for optimum transmission of an ion in FAIMS could be achieved by using the actual functional dependence of K(E) for the ion in question. If a particular ion has mobility that depends on field as $K(E)=K_L(1+\alpha E^3)$ where $\alpha$ is a constant as described above, then if the "cube" algorithm is applied, the waveform generator will produce a wave that maximizes the CV of this ion. In general the functional dependence on field has been written as $K(E)=K_L(1+\alpha E^2+\beta E^4)$, where $K^L$ is the mobility at low field (and has no field-dependence). With the application of the asymmetric waveform, we are therefore trying to maximize the value of the integral of K(E), which is equivalent to maximizing the integral of K(V(t)), and equivalent to maximizing the integral of $K_L(1+aV(t)^2+bV(t)^4)$ over one cycle of the waveform, where a and b are proportional to $\alpha$ and $\beta$ respectively, which in turn is equivalent to maximizing $[aV(t)^2+bV(t)^4]$ over one cycle of the waveform. In practice, this is reduced to the following algorithm. The data points of the measured signal voltages of the applied asymmetric waveform are normalized. Each point is squared and multiplied by "a", and also raised to the fourth power and multiplied by "b", and these two value are added together. Since this function is "even", where both positive and negative input values result in an output value of the same sign, the sign of the original data point is then applied to this calculated value. The set of computed values from one cycle of the waveform is reduced to one numerical value by addition of all the points, or by averaging all the points, or by computing the equivalent of the integral of these values over this cycle of the waveform. The waveform parameters of phase angle and ratio of A/B are then modified in an iterative manner to maximize the value of this computed integral for one cycle of the waveform. This procedure will result in a waveform that is very similar to, but not necessarily exactly like that of equations (1) and (2). In all cases the phase angle will remain exactly $\pi/2$. The ratio of A/B will vary from 2.0 in order to maximize the CV for the particular ion that was used to produce the values of $\alpha$ or and $\beta$, or a and b respectively. Consider some examples applied to a normalized positive polarity waveform V(t): (1) the average value of $[V(t)]^3$ will maximize at 0.111 and at this condition A/B is 2 and phase angle is $\pi/2$, (2) the average value of the correctly signed $[V(t)]^2$ will maximize at 0.0852 when A/B is 1.70 and phase angle is $\pi/2$, (3) the average value of the correctly signed $[V(t)]^4$ will maximize at 0.117 when A/B is 2.30 and phase angle is $\pi/2$, and (4) the average value of the correctly signed $([V(t)]^2-0.3[V(t)]^4)$ will maximize at 0.051 when A/B=1.61 and the phase angle is $\pi/2$. This last function was selected because it appears to mimic the actual functionality of the ion mobility of some types of ions at high electric field strength. Note however that this last function has a second derivative that is negative over a small region between zero and one. These paragraphs of detailed description have been included in this document in order to enable a person skilled in the art to exactly understand the scope and limitations in selecting functions to be used to optimize the waveform generator, and to show that the 'rules' of the functions regarding signs and derivatives were given above to enable a less-skilled individual to select a function that will work with FAIMS. It is clear that a wider allowable set of functions is available, beyond the 'rules' described above, but a selection of these additional functions requires a complete understanding of the operation of FAIMS. These notes are also intended to allow a skilled individual to select a function that will yield a waveform having extended advantages, not limited by the 'rules' outlined above. For more clarity, the function applied to processing the optimization of the waveform can be tailored to match the change in the mobility of the ion in strong electric fields, and the CV can thus be maximized.

From this discussion it is also clear that equation (1) and (2) are not the only available equations for the asymmetric waveform, nor are necessarily the waveforms that give the maximum CV for a particular compound. For a given compound, the waveform that yields the highest CV will often provide the best opportunity for improvement of the signal to background ratio, improvement of separation from other compounds, and for maximizing the signal intensity due to better focusing at higher CV. Many benefits of application of asymmetric waveforms tailor-made for specific compounds can be expected.

The cube root function cannot be used, because, although it is monotonic increasing (and decreasing in the negative values) and it retains the signs of the data, this function does not give a useful average value. In this case the function (applied to positive values) does not have a monotonic increasing first derivative (i.e, it has a negative second derivative). In this case the derivative of x^(⅓) is (⅓)x^(−⅔), thus the derivative is not increasing as the input values are increased and its second derivative is negative.

The logarithm function cannot be used because the magnitudes of the results from calculation for the positive and negative points would be different, i.e., log(x) is not equal to log(−x), which doesn't exist. Even if this problem is corrected using the "modified log function" such that log(−x) is defined to be −log(abs(x)), where abs(x) is the absolute value of x, the second derivative of the logarithm function is negative. On the other hand the exponential function can be used if the effect of the sign of the data point is eliminated. For example, a "modified exponential" function is defined, in which the exponential of the absolute values of the data points are taken, followed by an application of the sign of the original data point. In other words, the function sgn(x) is defined to give +1 for positive, and −1 for negative values of x, which allows a modified exponential function, sgn(x)exp(abs(x)), to be defined, where abs(x) is the absolute value of x. The second derivative of this modified exponential is positive for positive values of x and negative for negative values of x.

The functions to be used in this optimization process therefore are not limited to cube, modified square, modified exponential functions, but rather all functions with the appropriate properties including derivatives. The application of the above information of applying a function to further analyze data points permits a simple process for feedback and control of the asymmetric waveform in FAIMS. The electronics of the waveform generator preferably includes a microprocessor which processes the output of a fast or slow A/D converter programmed to collect sufficient data points to monitor the generated asymmetric waveform. Since the data points may be taken randomly, a random distribution may require the collection of a larger number of points than a systematic, high frequency A/D with evenly spaced (in time) points. The points are processed by the "average of the cubes", or some other function, method as described above. If the value of this "average of the cubes" data processing is lower than the predicted +0.111 for a positive polarity (DV) waveform then corrective action is taken.

Numerous other embodiments may be envisaged without departing from the spirit and scope of the instant invention.

What is claimed is:

1. A method of controlling an asymmetric waveform generated as a combination of a plurality of sinusoidal waves including two sinusoidal waves having a frequency that differs by a factor of two, the method comprising the steps of:

sampling the generated asymmetric waveform to obtain a set of data points that is indicative of the generated asymmetric waveform;

normalizing each data point of the set of data points;

determining at least a value relating to the normalized data points;

comparing the determined at least a value to template data relating to an ideal asymmetric waveform; and, in dependence upon the comparison, effecting a change to the generated asymmetric waveform.

2. A method according to claim 1, wherein the step of determining at least a value relating to the normalized data points is performed other than in dependence upon an order relating to the magnitude of the data points.

3. A method according to claim 1, wherein the step of sampling is performed as an analog-to-digital sampling for collecting data points contained within one cycle of the generated asymmetric waveform.

4. A method according to claim 1, wherein the step of sampling is performed as an analog-to-digital sampling, for collecting data points from a plurality of portions of the generated asymmetric waveform during a period of time overlapping with a plurality of different cycles of the generated asymmetric waveform.

5. A method according to claim 1, wherein each data point includes information relating to a value of V(t) at a time t, where V(t) is the asymmetric waveform voltage as a function of time.

6. A method according to claim 5, wherein the step of determining at least a value relating to the normalized data points includes the steps of:

applying a predetermined function to each normalized data point, to determine a resultant value for each normalized data point; and, determining one of an average and a sum of the resultant values for each normalized data point.

7. A method according to claim 6, wherein the predetermined function is one of a monotonic increasing function and a monotonic decreasing function over a range of values including the normalized data points.

8. A method according to claim 6, wherein the first derivative of the predetermined function is one of a monotonic increasing function and a monotonic decreasing function over the range of normalized data points.

9. A method according to claim 6, wherein the predetermined function is an odd function, defined as $f(-x)=-f(x)$.

10. A method according to claim 6, wherein the predetermined function is selected from the group consisting of: a cube function; a modified square function; and, a modified exponential function.

11. A method according to claim 6, wherein the predetermined function provides a resultant value that is one of (a) positive for all positive data points and negative for all negative data points and (b) negative for all positive data points and positive for all negative data points.

12. A method according to claim 11, wherein the resultant value is the same absolute value whether the data point is positive or negative.

13. A method according to claim 5, wherein the time dependent part of the generated asymmetric waveform has the general form $V(t)=A\sin(\omega t)+B\sin(2\omega t-\Theta)$, where A is the amplitude of a first sinusoidal wave at frequency $\omega$, where $\omega$ is the frequency in radians/sec, B is the amplitude of a second sinusoidal wave at a frequency $2\omega$, and $\Theta$ is a phase angle offset in radians between the first sinusoidal wave and the second sinusoidal wave.

14. A method according to claim 13, comprising a step prior to the step of sampling the generated asymmetric waveform of setting the value of A+B to a predetermined value.

15. A method according to claim 13, wherein the effected change is for satisfying the condition $\Theta=\pi/2$.

16. A method according to claim 13, wherein the effected change is for satisfying the condition that A/B equals a predetermined value.

17. A method according to claim 1, wherein the step of effecting a change to the generated asymmetric waveform is performed in an iterative fashion until the generated asymmetric waveform approximates the ideal asymmetric waveform.

18. A method of controlling an asymmetric waveform generated as a combination of a plurality of sinusoidal waves including two sinusoidal waves having a frequency that differs by a factor of two, the method comprising the steps of:

sampling the generated asymmetric waveform to determine a plurality of data points from a plurality of different cycles of the generated asymmetric waveform, the plurality of data points being indicative of a shape of the generated asymmetric waveform;

analyzing the plurality of data points indicative of a shape of the generated asymmetric waveform, the step of analyzing being performed other than in dependence upon an order of magnitude of the data points; and, in dependence upon the step of analyzing, effecting a change to the generated asymmetric waveform.

19. A method according to claim 18, wherein each data point includes information relating to a value of V(t) at a time t, where V(t) is the asymmetric waveform voltage as a function of time.

20. A method according to claim 19, wherein the time dependent part of the generated asymmetric waveform has the general form $V(t)=A\sin(\omega t)+B\sin(2\omega t-\Theta)$, where A is the amplitude of a first sinusoidal wave at frequency $\omega$, where $\omega$ is the frequency in radians/sec, B is the amplitude of a second sinusoidal wave at a frequency $2\omega$, and $\Theta$ is a phase angle offset in radians between the first sinusoidal wave and the second sinusoidal wave.

21. A method according to claim 20, comprising a step prior to the step of sampling the generated asymmetric waveform of setting the value of A+B to a predetermined value.

22. A method according to claim 20, wherein the effected change is for satisfying the condition $\Theta=\pi/2$.

23. A method according to claim 20, wherein the effected change is for satisfying the condition that A/B equals a predetermined value.

24. A method according to claim 19, wherein the step of determining at least a value relating to the normalized data points includes the steps of:

applying a predetermined function to each normalized data point, to determine a resultant value for each normalized data point; and, determining one of an average and a sum of the resultant values for each normalized data point.

25. A method according to claim 18, wherein the frequency of sampling has other than a well defined relation to the frequency of the asymmetric waveform.

26. A method according to claim 18, wherein the step of effecting a change to the generated asymmetric waveform is performed in an iterative fashion until the generated asymmetric waveform approximates the ideal asymmetric waveform.

27. A storage medium encoded with machine-readable computer program code for controlling an asymmetric waveform generated as a combination of a plurality of sinusoidal waves including two sinusoidal waves having a frequency that differs by a factor of two, the storage medium including instructions for:

obtaining a set of data points that is indicative of the generated asymmetric waveform;

normalizing the data points of the set of data points;

applying a predetermined function to the normalized data points of the set of data points, to determine a set of resultant values including one resultant value corresponding to each normalized data point of the set of normalized data points;

determining at least a value relating to the set of resultant values;

comparing the determined at least a value to template data relating to an ideal asymmetric waveform; and, in dependence upon the comparison, adjusting at least one of a phase angle difference between the two sinusoidal waves and an amplitude of at least one of the two sinusoidal waves.

28. A storage medium according to claim 27, wherein the instructions for applying a predetermined function to the normalized data points of the set of data points includes instructions for applying the predetermined function other than in dependence upon an order relating to the magnitude of the data points of the set of data points.

* * * * *